US009335738B2

(12) United States Patent
Oes et al.

(10) Patent No.: US 9,335,738 B2
(45) Date of Patent: May 10, 2016

(54) BARREL

(71) Applicants: Stephane Oes, La Chaux-de-Fonds (CH); Laurent Calame, La Sagne (CH)

(72) Inventors: Stephane Oes, La Chaux-de-Fonds (CH); Laurent Calame, La Sagne (CH)

(73) Assignee: SOWIND SA, La Chaux-de-Fonds (CH)

( * ) Notice: Subject to any disclaimer, the term of this patent is extended or adjusted under 35 U.S.C. 154(b) by 0 days.

(21) Appl. No.: 14/383,635

(22) PCT Filed: Mar. 8, 2013

(86) PCT No.: PCT/EP2013/054765

§ 371 (c)(1),
(2) Date: Sep. 8, 2014

(87) PCT Pub. No.: WO2013/132076

PCT Pub. Date: Sep. 12, 2013

(65) Prior Publication Data

US 2015/0138932 A1 May 21, 2015

(30) Foreign Application Priority Data

Mar. 9, 2012 (CH) ..... 340/12

(51) Int. Cl.
*G04B 1/00* (2006.01)
*G04B 1/10* (2006.01)
(Continued)

(52) U.S. Cl.
CPC .. *G04B 1/16* (2013.01); *G04B 1/10* (2013.01); *G04B 1/12* (2013.01); *G04B 1/165* (2013.01); *G04B 1/18* (2013.01); *G04B 1/185* (2013.01); *G04B 1/20* (2013.01); *Y10T 29/49579* (2015.01)

(58) Field of Classification Search
CPC ..... G04B 1/10; G04B 1/12; G04B 1/16; G04B 1/165; G04B 1/18; G04B 1/185; G04B 1/20
USPC ..... 368/139, 140, 142–144
See application file for complete search history.

(56) References Cited

U.S. PATENT DOCUMENTS 249,845 A 11/1881 Lewis
410,327 A * 9/1889 Meylan ..... G04B 1/12 368/142

(Continued)

FOREIGN PATENT DOCUMENTS

BE 567 865 6/1958
CH 90 009 7/1921

(Continued)

OTHER PUBLICATIONS

Scheufele, Karl Friedrich, EP 1115040 A1 English Translation, Jul. 2001, whole document.*

(Continued)

*Primary Examiner* — Amy Cohen Johnson
*Assistant Examiner* — Daniel Wicklund
(74) *Attorney, Agent, or Firm* — Young & Thompson

(57) ABSTRACT

A timepiece barrel includes a drum defining a first compartment and a superimposed second compartment; a first tubular hub secured to a first cover and housed at least partially in the first compartment; a second tubular hub secured to a second cover housed at least partially in the second compartment. Each compartment contains a spring wound into a spiral and an inner first end of which collaborates with the first and second hubs respectively and a second end of which collaborates with the drum. The compartments are open on the side of the covers and the first and second covers are free with reference to the drum and are each provided with peripheral teeth, while the drum has no teeth.

20 Claims, 5 Drawing Sheets

(51) Int. Cl.

| | |
|---|---|
| ***G04B 1/16*** | (2006.01) |
| ***G04B 1/18*** | (2006.01) |
| ***G04B 1/20*** | (2006.01) |
| ***G04B 1/12*** | (2006.01) |

(56) References Cited

U.S. PATENT DOCUMENTS

| | | | | |
|---|---|---|---|---|
| 1,796,374 | A * | 3/1931 | Kendle | 368/142 |
| 4,117,664 | A * | 10/1978 | Mathys | 368/318 |
| 4,363,553 | A * | 12/1982 | Thomi et al. | 368/140 |
| 8,430,559 | B2 | 4/2013 | Musy et al. | |
| 2005/0249045 | A1 * | 11/2005 | Schneider | 368/140 |
| 2007/0091728 | A1 * | 4/2007 | Girardin et al. | 368/142 |
| 2010/0246339 | A1 * | 9/2010 | Mertenat | 368/142 |
| 2011/0222376 | A1 * | 9/2011 | Musy et al. | 368/140 |

FOREIGN PATENT DOCUMENTS

| | | | | |
|---|---|---|---|---|
| CH | 699 988 | | 5/2010 | |
| CH | 704249 | A1 * | 6/2012 | |
| EP | 1115040 | A1 * | 7/2001 | G04B 1/12 |
| GB | 103121 | A * | 5/1918 | |
| GB | 147 339 | | 7/1920 | |
| WO | 2011/117695 | | 9/2011 | |
| WO | WO 2013189856 | A2 * | 12/2013 | |

OTHER PUBLICATIONS

International Search Report dated May 3, 2013, corresponding to PCT/EP2013/054765.

* cited by examiner

BARREL

TECHNICAL FIELD

The present invention relates to the field of mechanical horology. It more particularly relates to a barrel comprising:

- a drum defining first and second superimposed compartments,
- a first tubular hub secured to a first cover and housed at least partially in the first compartment,
- a second tubular hub secured to a second cover housed at least partially in the second compartment.

Each compartment contains a spring wound in a spiral, one inner end of which cooperates with the first and second hubs, respectively, and a second end of which cooperates with the drum.

BACKGROUND OF THE INVENTION

In mechanical watches, the energy is generally provided by springs wound in a spiral and housed in barrels. Depending on the case, one seeks to obtain the maximum amount of energy in a given volume in order to optimize the transmitted torque and the power reserve, i.e., the maximum duration during which the barrel can cause the movement to operate under correct conditions. These parameters are theoretically improved by increasing the height of the coils (i.e., the dimension perpendicular to the plane of the spiral) and decreasing the thickness of the blade making up the spiral, allowing a larger number of coils for a barrel with a constant diameter. However, the manufacturing constraints of the springs quickly limit the possibilities for increasing the height or reducing the thickness.

It has already been proposed, in the state of the art, to associate several barrels, either in parallel or in series, in order to improve the transmitted torque or the power reserve. For example, document U.S. Pat. No. 4,363,553 proposes a construction in which two barrels, each containing a spring, are assembled in series.

The present invention aims to propose an alternative and advantageous construction, making it possible to improve the energy performance of a barrel in a limited bulk.

DETAILED DESCRIPTION OF THE INVENTION

More specifically, the invention relates to a barrel as well as a timepiece as defined in the claims.

BRIEF DESCRIPTION OF THE DRAWINGS

Other details of the invention will appear more clearly upon reading the following description, done in reference to the appended drawing, in which.

DETAILED DESCRIPTION OF THE INVENTION

Figure 1:
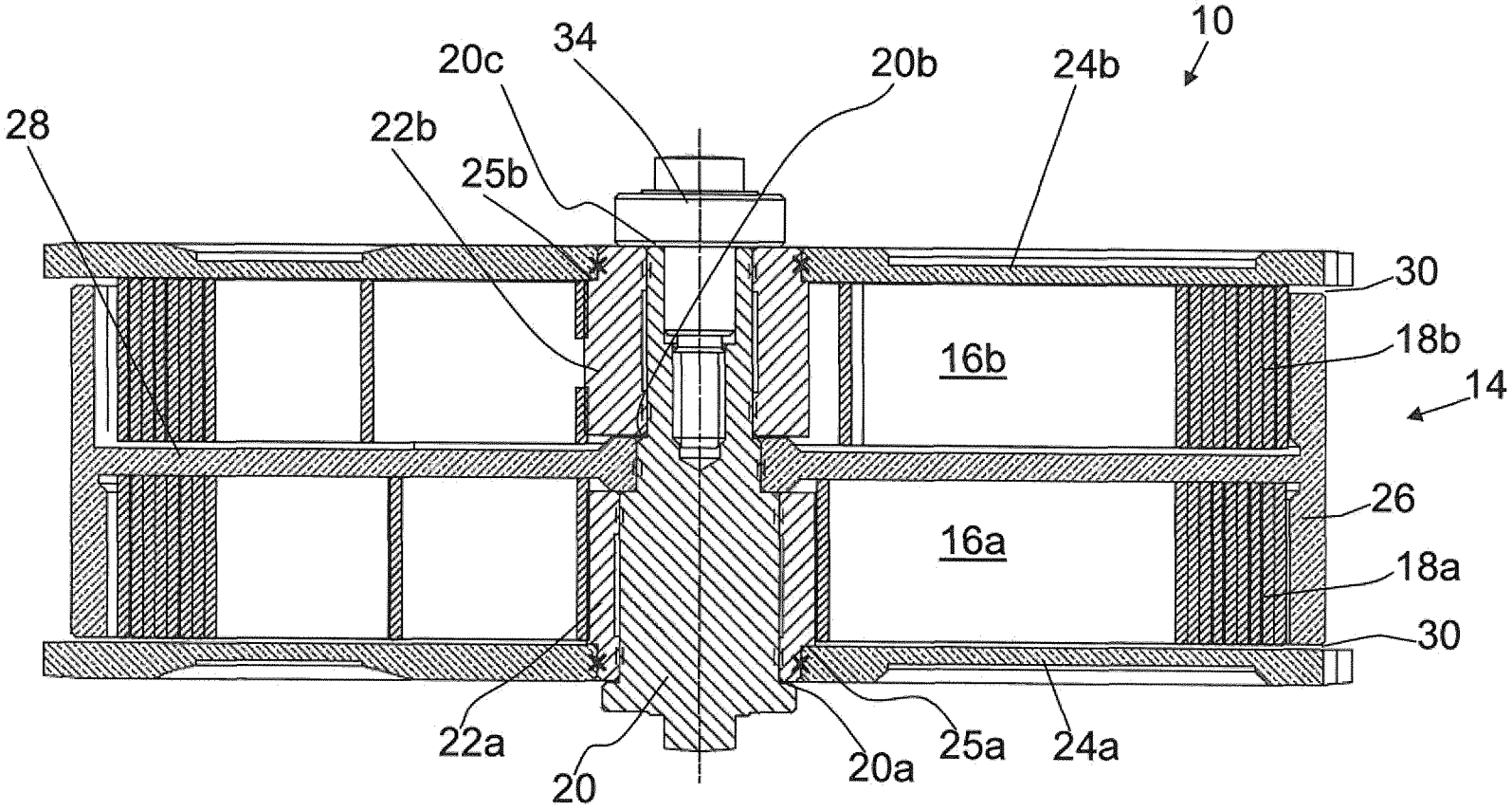
FIG. 1 is a cross-sectional view of a first embodiment of the invention.

FIG. 1 shows a barrel 10 of a timepiece illustrating the invention. This barrel 10 comprises a drum 14 that defines two compartments 16*a*, 16*b* that are superimposed relative to the geometric axis of the barrel and each containing a spring 18*a*, 18*b* wound in a spiral.

More specifically, the barrel includes first and second tubular hubs, which are separated. The first hub 22*a* is secured to a first cover 24*a*. The first hub 22*a* is at least partially housed in the first compartment 16*a*, called lower in reference to FIG. 1, while the second hub 22*b* is secured to a second cover 24*b*, and is at least partially housed in the second compartment 16*b*, called upper in reference to FIG. 1.

Each of the springs 18*a*, 18*b* is wound in a spiral. Their inner ends respectively cooperate with a hook with which the first and second hubs are provided and their outer end cooperates with the drum 14.

The compartments are open on the side of the covers. A cover refers to the element that covers, or even closes, a compartment of the drum. In the case of the invention, the first 24*a* and second 24*b* covers are free in reference to the drum 14 and are separated from the drum by an interstice 30. The covers 24*a* and 24*b* are each provided with a peripheral toothing, while the drum 14 has no toothing. One of these toothings is used to wind the springs, while the other is used to acquire force, to supply energy to a going train of a timepiece in which the barrel according to the invention is mounted. Depending on the construction of the timepiece in which the barrel according to the invention is designed to be mounted, one skilled in the art may choose to use either of the covers to arm or provide energy.

Owing to the fact that the covers 24*a*, 24*b* are independent of the drum 14, it is possible to have a drum 14 with a diameter larger than that of one or both covers 24*a*, 24*b*, which makes it possible to increase the number of turns of the springs 18*a*, 18*b* and, therefore, the available power reserve. The covers can each be pressed on a shoulder 25*a*, 25*b* respectively included by the hubs 22*a* and 22*b*.

In the alternatives proposed in the figures, the drum 14 includes a cylindrical wall 26 and a planar wall 28, which are protruding relative to the cylindrical wall 26. The planar wall 28 is positioned substantially mid-height relative to the cylindrical wall 26 and delimits the compartment 16*a*, 16*b*. Preferably, the cylindrical wall 26 and the planar wall 28 are formed in a single piece.

At its center, the planar wall 28 defines an opening 28*a* positioned and sized so as to substantially extend a channel formed by the hubs 22*a* and 22*b*. At the opening 28*a*, the planar wall can have an excess thickness making it possible to position the hubs heightwise. The compartments 16*a* and 16*b* are thus defined between the lower 22*a* and upper 22*b* hubs and the walls of the drum 14.

The first balance spring 18*a* and the second balance spring 18*b* are respectively placed in these compartments 16*a*, 16*b*. For each of them, the inner end cooperates with the lower hub 22*a* or the upper hub 22*b*, via the aforementioned hooks. The outer end of the springs 18*a*, 18*b* cooperates with the cylindrical wall 26 of the drum 14. One skilled in the art may consider realizing a fixed or sliding cooperation, of the type known in the field of barrels.

Figure 2:
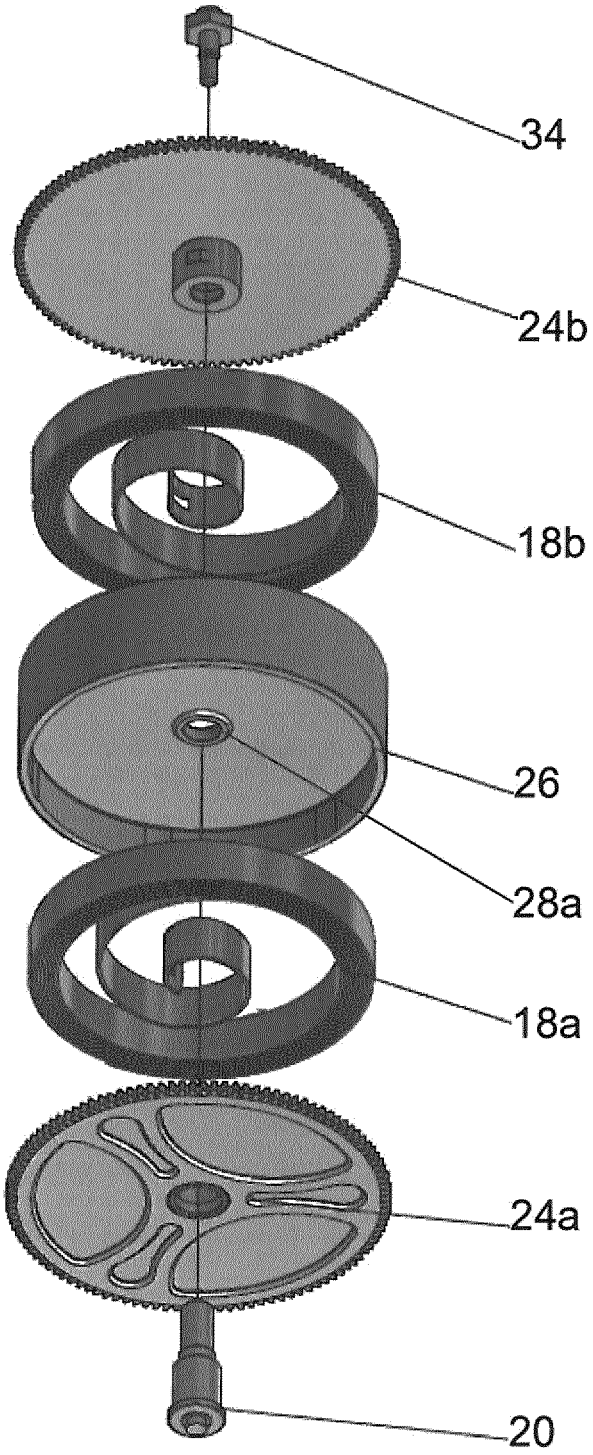
FIG. 2 shows an exploded view of that same first embodiment.

As shown in FIG. 2, the two springs 18*a*, 18*b* are mounted such that the spirals that they describe are in opposite directions. The two springs of the barrel 10 being connected to each other via the cylindrical wall 26 of the drum 14, they are thus arranged in series.

Figure 3:
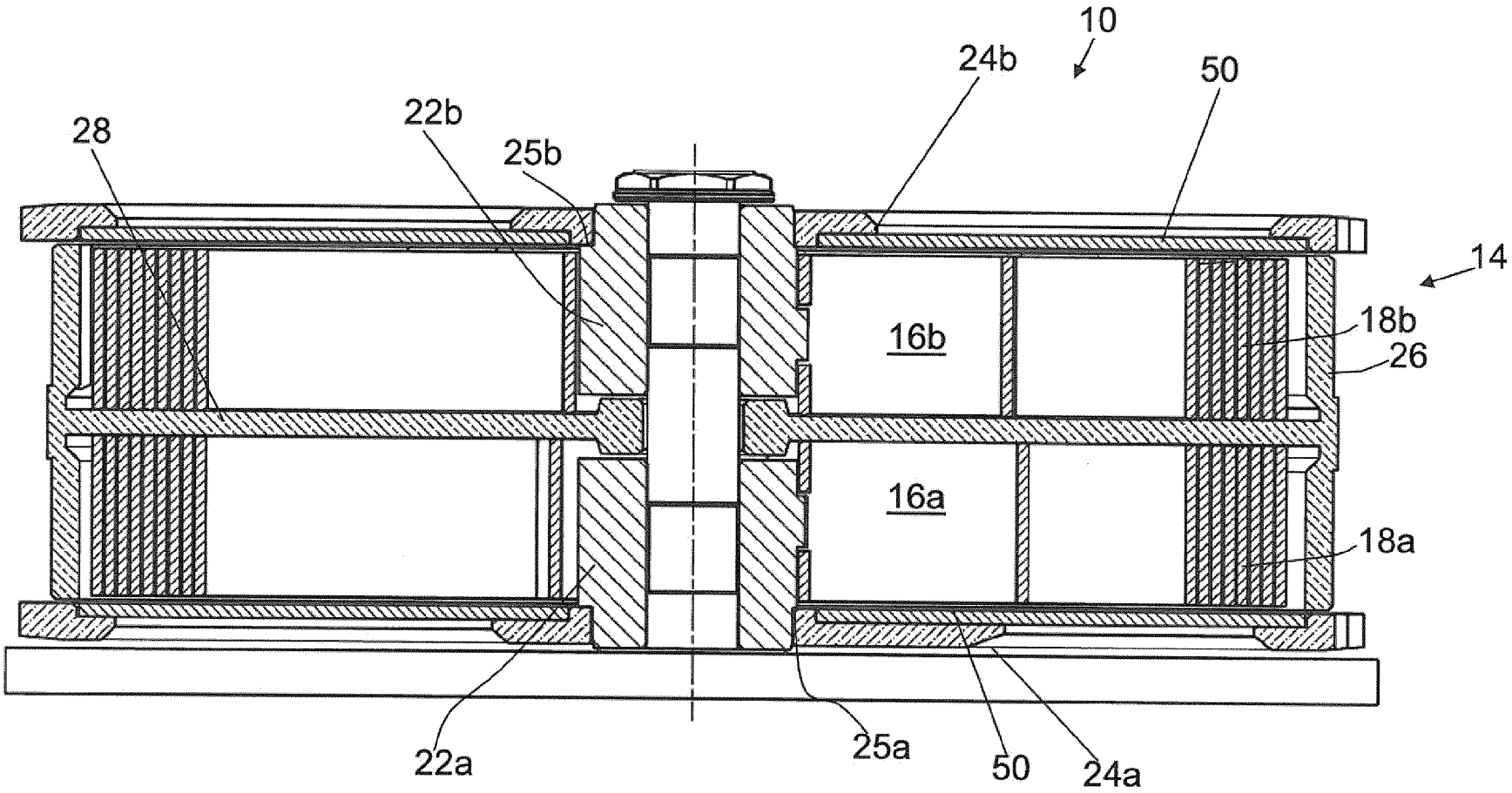
FIGS. 3, 4 and 5 are cross-sectional views of second and third embodiments of the invention.

Advantageously, as illustrated in FIG. 3, at least one of the covers is provided with an antifriction coating 50 on its face situated across from the compartments. Preferably, both covers are thus provided with such an antifriction coating 50. Likewise, although not shown in the drawings, the planar wall 28 can be provided with an antifriction coating on at least one of its faces situated across from the compartments, preferably on both faces.

The antifriction coating may be made by a washer fastened to the cover 24*a*, 24*b* or to the planar wall 28. The washer may be glued or deposited on the cover or on the planar wall. A frame may be provided in the covers and/or in the planar wall, to receive the coating. The antifriction coating may be made from a material chosen from among PTFE (polytetrafluoroethylene), DLC (diamond-like carbon), silicon, or another hard material within the reach of one skilled in the art. It is possible to obtain an interesting esthetic effect by making the antifriction coating 50 with which the cover is provided visible, through openings formed in the cover.

Particularly advantageously, it is possible to see that the barrel 10 according to the invention does not include a pivot, within the usual meaning in the horology field. Indeed, generally, the barrels of the state of the art include a staff on which the inner end of the spring is mounted. The ends of the staff define pivots that pivot in bearings of the frame of the timepiece in which the barrel is mounted. According to the invention, the hubs and the drum pivot on a fixed arbor 20 that is placed in the channel defined by the hubs 22*a* and 22*b* and three central opening 28*a* of the planar wall. In the embodiment of FIG. 1, the arbor 20 is arranged in the frame of the timepiece. The barrel as defined by the present invention forms a functional whole consisting of the hubs 22*a* and 22*b*, the drum 14 and the springs 18*a* and 18*b*. According to this definition, the barrel pivots on the arbor 20 associated with it.

The arbor 20 serves to guide the rotation of the barrel, without defining a pivot relative to the frame of the timepiece. In the embodiment of FIG. 1, the arbor 20 may advantageously include steps 20*a*, 20*b* making it possible to allow heightwise positioning, i.e., along the axis of the arbor, of the hubs 22*a* and 22*b* and the drum 14. Thus, the arbor also participates in defining the axial positioning means of the barrel, making it possible to maintain the relative positioning of the elements making up the barrel. The arbor 20 can receive a stepped screw 34 or a nut, tightened against a third step 20*c* of the arbor. It will be noted that the axial positioning means do not restrict the hubs against one another and leave them freely rotating.

In the embodiment of FIG. 3, the arbor 20 is provided to be able to be assembled on the timepiece independently relative to the components of the barrel. As for the first alternative, the arbor participates both in the axial positioning means and the rotational driving means. The arbor can thus receive a stepped screw 34 or a nut axially maintaining the hubs and the drum.

Figure 4:
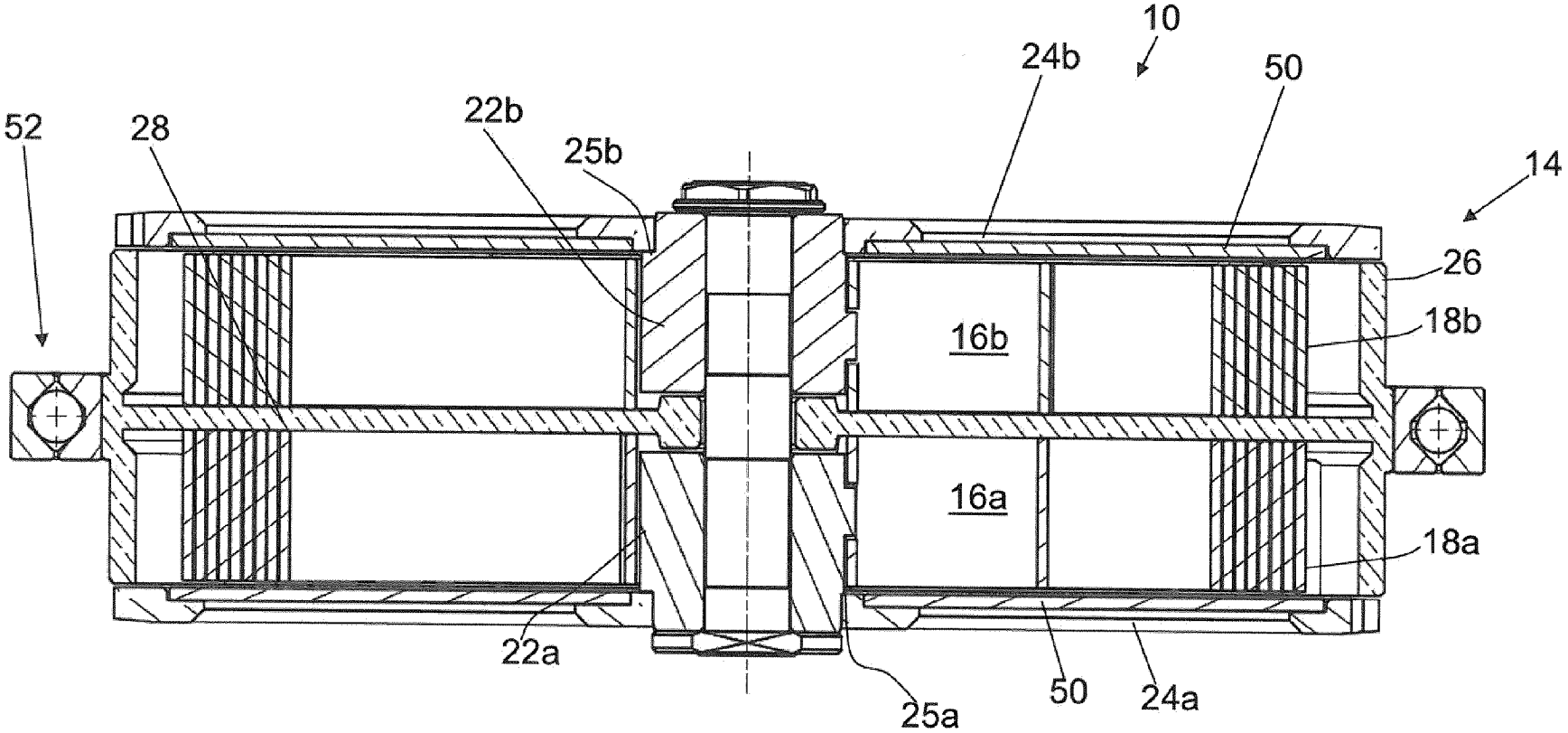

In the alternative of FIG. 4, the arbor is designed to be free and independent relative to the plate and only defines the axial positioning means. The rotational driving means of the drum is a rolling bearing 52 acting at the periphery of the drum. The rolling bearing serves as an interface between the drum and the frame of the timepiece and makes it possible to suspend the barrel, without using a bridge. It is also possible to use outer runners to ensure the pivoting of the drum.

For the assembly of the barrel, the following steps are carried out:

- mounting the lower hub 22*a* on the arbor 20,
- mounting the drum 14 associated with the springs 18*a* and 18*b* on the arbor 20,
- connecting the lower spring 18*a* to the lower hub 22*a*,
- mounting the upper hub 22*b* on the arbor 20,
- connecting the upper spring 18*b* to the upper hub 22*b*,
- positioning the axial positioning means, in the case at hand by tightening the screw 34 in the arbor 20.

Figure 5:
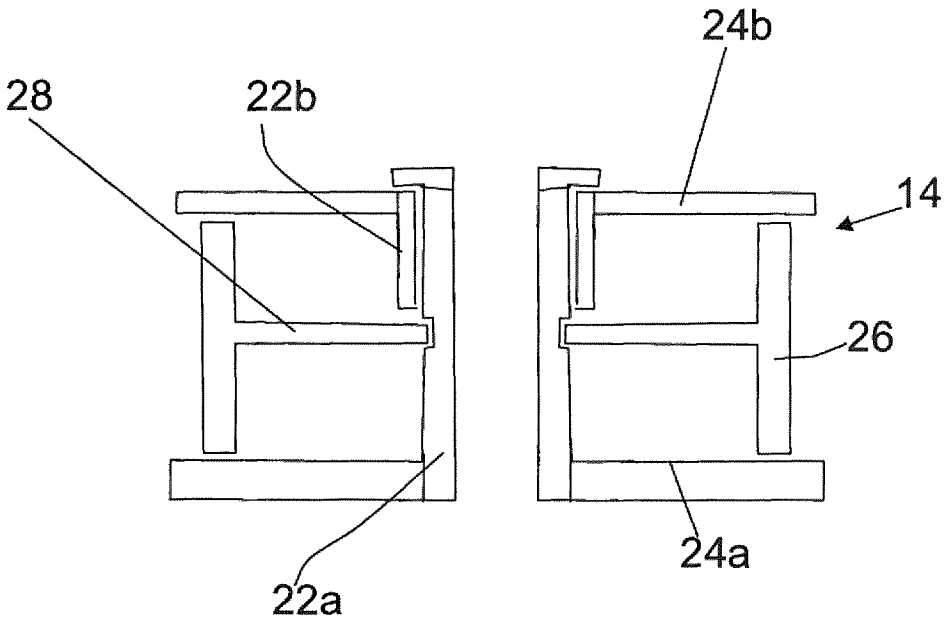

In the alternative diagrammed in FIG. 5, the lower hub 22*a* is used for rotational driving of the upper hub 22*b*. The lower hub 22*a* can advantageously participate in the axial positioning means by receiving a nut or a stepped screw 34 at its end. The lower hub forms a tube able to be positioned on a staff mounted secured to the timepiece. The barrel can thus form an independent functional assembly, with no pivot or axis of rotation, able to be assembled independently of the timepiece and next mounted on the staff, previously fastened to the timepiece.

In this embodiment, the lower hub also acts as the arbor. Thus, the following steps are carried out:

- obtaining the lower hub 22*a*,
- mounting the drum 14 associated with the springs 18*a* and 18*b* on the lower hub 22*a*,
- connecting the lower spring 18*a* to the lower hub 22*a*,
- mounting the upper hub 22*b* on the lower hub 22*a*,
- connecting the upper spring 18*b* to the upper hub 22*b*,
- positioning the axial positioning means, in the case at hand by tightening the screw 34 in the lower hub 22*a*.

It will be noted that from a practical perspective, the springs can be connected to the respective hubs by causing each of the hubs to rotate until its hook cooperates with the inner end of the spring.

Thus, if the barrel 10 is connected with the winding system by the lower cover 24*a*, the lower spring 18*a* will be armed via the lower hub 22*a*. Gradually, the lower spring 18*a* empties into the upper spring 18*b*, via the drum 14, driving the arming of the upper spring 18*b*. The torque is then available at the upper cover 24*b*, via the upper hub 22*b*. It is also possible to reverse this arrangement by connecting the upper cover to the winding system and the lower cover to the going train.

The proposed constructions are advantageously simple inasmuch as they comprise a reduced number of parts and a small bulk. The two springs can be mounted independently of one another, which also facilitates assembly operations.

One thus obtains a barrel 10 incorporating two springs 18*a*, 18*b*, making it possible to increase the torque provided by the barrel or the power reserve. It is then possible to propose associating such barrels, in series or in parallel, for example by connecting two barrels 10 as described above, using an intermediate wheel, meshing with the upper cover of the two barrels 10. This intermediate wheel may, for example, be the middle wheel of the movement.

One skilled in the art may choose for the springs used to be either automatic winding springs, i.e., allowing limitation of the arming, or manual winding springs, rigidly cooperating with the drum 14.

The invention claimed is:

1. A timepiece barrel, comprising:

a drum defining first and second superimposed compartments, a first tubular hub secured to a first cover and housed at least partially in the first compartment, a second tubular hub secured to a second cover housed at least partially in the second compartment, said second tubular hub rotating independently from said first tubular hub, each compartment containing a spring wound in a spiral, one inner end of which cooperates with the first and second hubs, respectively, and a second end of which cooperates with the drum, said compartments being open on the side of the covers, and in that said first and second covers are free relative to the drum and are each provided with a peripheral toothing, while the drum has no toothing.

2. The barrel according to claim 1, wherein said barrel as such does not include pivots designed to pivot on a timepiece plate.

3. The barrel according to claim 2, wherein said drum includes a cylindrical wall and a planar wall, protruding relative to the cylindrical wall, said planar wall delimiting said compartments.

4. The barrel according to claim 3, wherein said planar wall provided with an antifriction coating on at least one of a face of said planar wall situated across from said first or second compartment.

5. The barrel according to claim 4, wherein said cylindrical wall and the planar wall are formed in a single piece.

6. The barrel according to claim 3, wherein said cylindrical wall and the planar wall are formed in a single piece.

7. The barrel according to claim 1, wherein at least one of said first and second covers is provided with an antifriction coating on a face of said first or second covers situated across from said first or second compartment, respectively.

8. The barrel according to claim 7, wherein said antifriction coating is made by a washer fastened to the cover or to said planar wall.

9. The barrel according to claim 7, wherein said antifriction coating is made from a material chosen from among PTFE, DLC or silicon.

10. The barrel according to claim 7, wherein said first and second hubs are positioned by axial positioning means positioning them relative to one another.

11. The barrel according to claim 10, wherein the first hub is housed in the first and second compartments and in that the second hub is pivoted on the first hub, the axial positioning means being arranged to cooperate with said first hub.

12. The barrel according to claim 7, associated with a rotational guiding arbor, said arbor being designed to be fixed.

13. A timepiece comprising a barrel according to claim 12 and a rotational guiding means for the drum.

14. The timepiece according to claim 13, wherein said rotational guiding means for the drum is arranged so as to act on the periphery of the drum, said barrel being suspended.

15. The timepiece according to claim 13, wherein said rotational guiding means is an arbor secured to the frame of the timepiece and in that said arbor participates in the axial positioning means of the barrel.

16. A method for assembling a timepiece according to claim 15, including the following steps:

mounting the lower hub on the arbor, mounting the drum associated with the springs on the first hub, connecting the lower spring to the first hub, mounting the second hub on the arbor, connecting the second spring to the second hub, positioning the axial positioning means on the arbor.

17. The barrel according to claim 1, wherein said drum includes a cylindrical wall and a planar wall, protruding relative to the cylindrical wall, said planar wall delimiting said compartments.

18. The barrel according to claim 17, wherein said planar wall is provided with an antifriction coating on at least one of a face of said planar wall situated across from said first or second compartment.

19. The barrel according to claim 18, wherein said cylindrical wall and the planar wall are formed in a single piece.

20. The barrel according to claim 17, wherein said cylindrical wall and the planar wall are formed in a single piece.

* * * * *